US005616051A

United States Patent [19]

Rogers et al.

[11] Patent Number: 5,616,051

[45] Date of Patent: Apr. 1, 1997

[54] A.C. MAINS ADAPTERS FOR INTERNATIONAL USE

[75] Inventors: Conrad Rogers, Belmont; Daniele G. De Iuliis, San Francisco, both of Calif.

[73] Assignee: Apple Computer, Inc., Cupertino, Calif.

[21] Appl. No.: 493,381

[22] Filed: Jun. 21, 1995

[51] Int. Cl.[6] ..... H01R 29/00

[52] U.S. Cl. ..... 439/518; 439/171; 439/956

[58] Field of Search ..... 439/131, 171, 439/172, 173, 218, 221, 518, 956

[56] References Cited

U.S. PATENT DOCUMENTS

| | | | |
|---|---|---|---|
| 3,079,475 | 2/1963 | Rumble | 439/172 |
| 3,996,546 | 12/1976 | Hugly | 439/221 |
| 4,815,983 | 3/1989 | Erickson et al. | 439/173 |
| 4,973,827 | 11/1990 | Nozaki | 439/172 |
| 4,997,381 | 3/1991 | Oh | 439/131 |
| 5,159,545 | 10/1992 | Lee | 439/173 |
| 5,474,464 | 12/1995 | Drewnicki | 439/172 |
| 5,494,449 | 2/1996 | Chioo | 439/131 |

FOREIGN PATENT DOCUMENTS

| | | | |
|---|---|---|---|
| 2054876 | 5/1992 | Canada | 439/131 |
| 1346616 | 11/1963 | France | 439/221 |

*Primary Examiner*—Gary E. Elkins
*Attorney, Agent, or Firm*—Richard C. Liu

[57] ABSTRACT

A power connecting device for electrical appliances having two metal prongs for use with standard North American mains outlets; the prongs rotate to fold into a recess in the device. The recess protects the prongs for storage and transport, and is designed to accept slip-on adapters that slide into the recess, surrounding and mating with the folded down prongs and providing connection to the local mains connections in differing international locations.

2 Claims, 2 Drawing Sheets

A.C. MAINS ADAPTERS FOR INTERNATIONAL USE

BACKGROUND OF THE INVENTION

The present invention relates to power adapters and connector arrangements for adapting power supplies to connectors found in different countries.

Portable electronic devices commonly rely on AC adapters for operating the devices from the AC power mains, and charging batteries. Manufacturers of these devices, as well as their users, face problems in their use in different countries. The electronics arts have provided power supplies that can readily adapt to the wide range of operating voltages found around the world. But, this variety of operating voltages is a simple problem compared to the many different physical designs for power connectors that supply mains voltages. These power connectors vary from country to country. A number of solutions have evolved to this problem. One solution is to sell a different power adapter, with the proper connector configuration, for each country. This is a burden for manufacturer and user alike, and unsatisfactory to both. A second solution is to build a single power adapter having a connector for applying the mains voltage, and supplying adapter connectors tailored to the mains connectors required for each country. This is the approach used in the power supply for the Apple® Computer, Inc. Duo® series of portable computers (trademarks of Apple Computer, Inc.); a industry standard IEC receptacle is built into the power adapter, and separate adapters each having a corresponding IEC plug, and the required mains connector for that particular locale are provided. This reduces the manufacturing burden; only one power supply need be built, and one simple plug adapter for each locale. The user need only carry one supply, and a set of adapters for those countries needed. The user must always remember, however, to carry one adapter; if they remember to take the supply, but not the mains adapter, the supply cannot be used. A third solution is to build the supply with a permanent connector for one locale, and either supply adapters, or leave the problem to the ingenuity of the user. This is the approach used by the Apple Computer, Inc. PowerBook series of power supplies, such as the M5140 supply provided with the PowerBook 140 series of computers. This supply is permanently fitted with two metal prongs suitable for use in mains outlets commonly found in North America and Japan. Slip-on adapters, commonly found in convenience stores and at airport stores, adapt the standard North American prongs to the local mains standard. This solution also has a number of problems. First, the fixed metal prongs are a nuisance for the user in packing the device for transport. The prongs must be covered, or protected in some way so that they do not become bent during transit, and also so that the prongs do not damage other articles during transit. Of greater importance is that the use of simple slip-on adapters may not meet the safety certification requirements of some countries. What is needed is a simple scheme for adapting such devices to the varying connector standards of the world, in a manner that is economical to the manufacturer, convenient to the user, and safe.

SUMMARY OF THE INVENTION

A power connection for a device such as a power supply is provided by two metal prongs for use with standard North American AC mains outlets. These prongs rotate to fold down into a recess in the device for storage when they are not being used. The recess is designed to accept a slip-on adapter that slides into the recess, surrounding and mating with the folded down prongs, and providing a connection to the local mains outlets in international use.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

The preferred embodiment of the present invention is illustrated by way of example in FIGS. 1–4.

Figure 1:
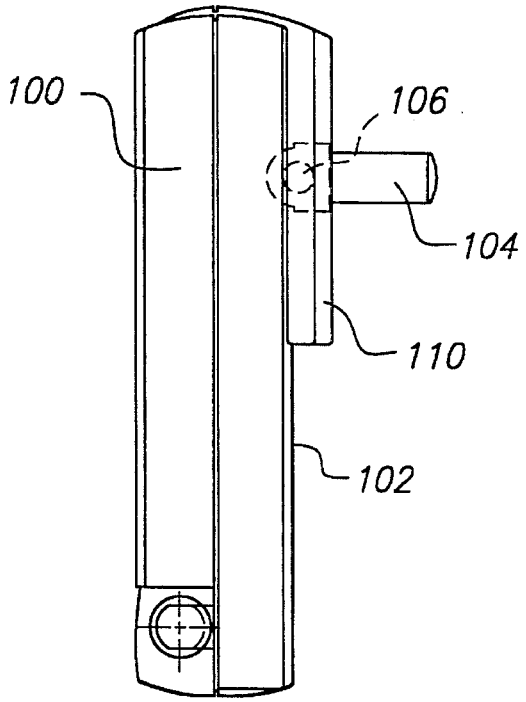
FIG. 1 is a side view of the device with prongs extended.

FIG. 1 shows a side view of an electrical device, such as a power supply, with prongs extended as for use with standard North American AC mains receptacles. Body 100 has base 102 with prongs 104 extending from pivot point 106. Also shown is mating ridge 110. As shown in FIG. 1 prongs 104 when extended may be inserted into standard North American AC mains receptacles for operating the device.

Figure 2A:
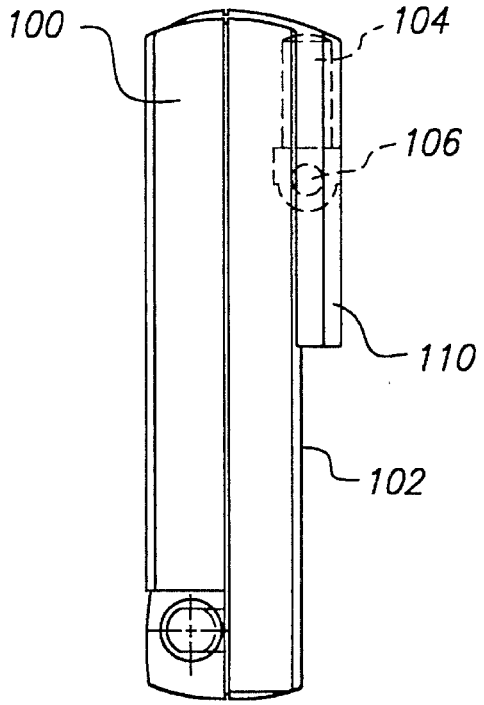
FIG. 2*a* is a side view of the device with prongs folded down.
Figure 2B:
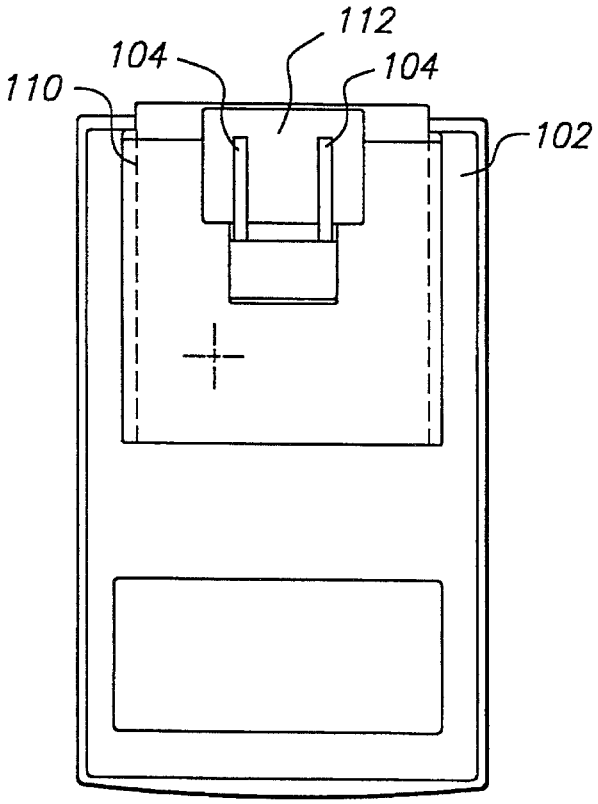
FIG. 2*b* is a bottom view of the device with prongs folded down.
Figure 2C:
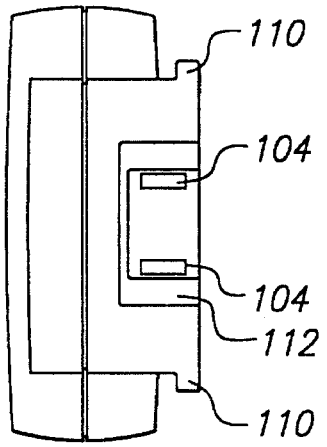
FIG. 2*c* is an end view of the device with prongs folded down.

FIG. 2*a* shows a side view of the device with prongs 104 rotated about pivot point 106 so that prongs 104 reside in cavity 112. FIG. 2*b* shows a bottom view of the device with prongs 104 residing in cavity 112. FIG. 2*c* shows an end view of the device with prongs 104 residing in cavity 112, and showing mounting ridge 110. As shown in FIG. 2*a*–2*c*, prongs 104 are folded into cavity 112, such as when packed for travel. In this manner prongs 104 are protected from damage from the outside environment, and conversely the outside environment is protected from damage that could be induced by prongs 104 if they were extended (as shown in FIG. 1).

Figure 3A:
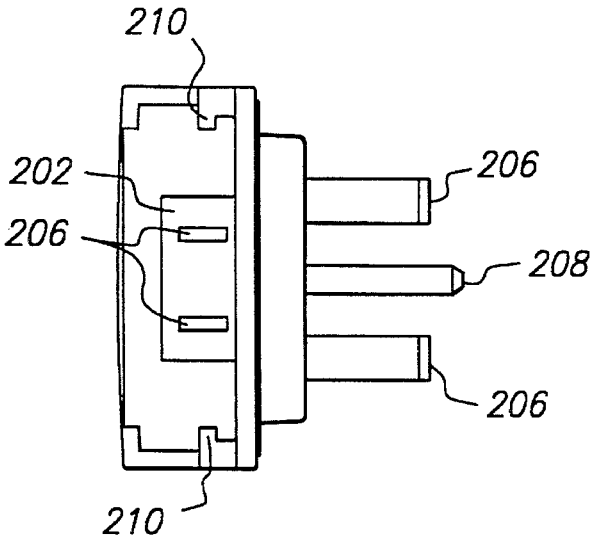
FIG. 3*a* is an end view of the mains adapter.
Figure 3B:
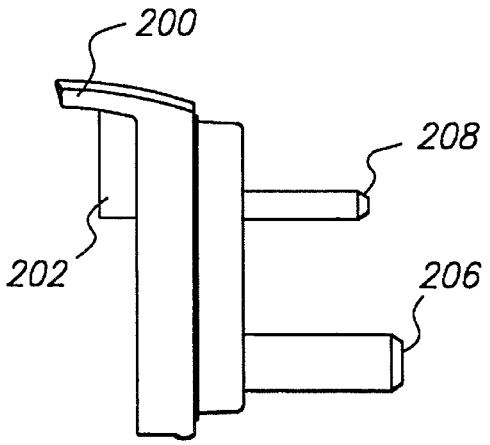
FIG. 3*b* is a side view of the mains adapter.

FIG. 3*a* shows an end view of a mains adapter. Adapter body 200 has receptacle body 202 with receptacle connectors 204, mating flange 210, and mains connectors 206. As shown, mains connectors 206 and dummy connector 208 are of a style suitable for the mains receptacles in the United Kingdom. Variations in prong style and spacing allow different adapters to be made for other countries. While only two electrical connections are provided by prongs 104 (of FIG. 1) and receptacle connectors 204, third dummy connector 208 is provided to provide proper electrical polarization and to comply with local safety requirements. FIG. 3*b* is a side view of the mains adapter.

Figure 4A:
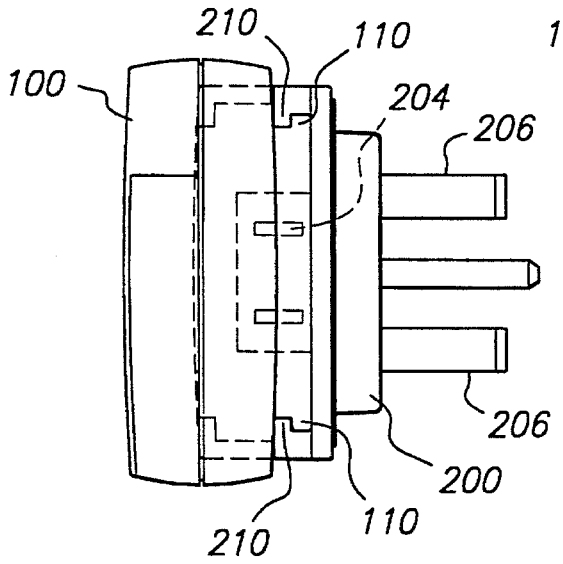
FIG. 4*a* is a end view of the device with the mains adapter in place.
Figure 4B:
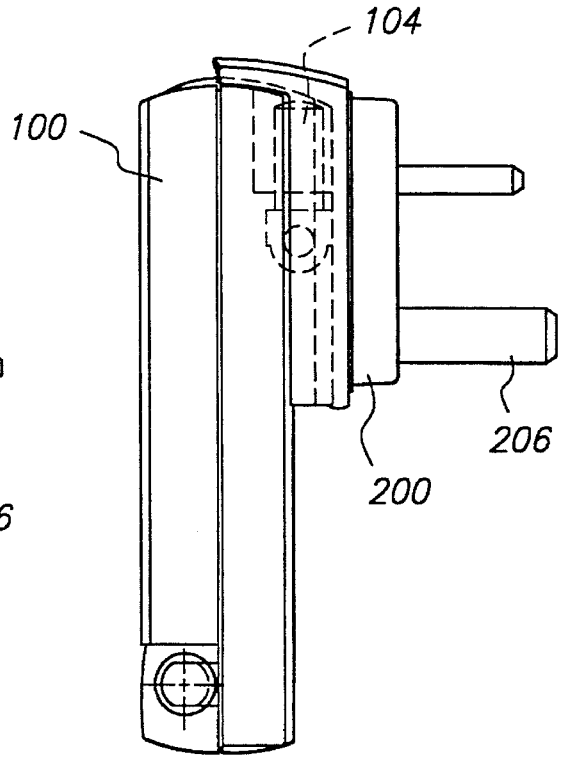
FIG. 4*b* is an side view of the device with the mains adapter in place.

FIG. 4*a* shows an end view of the device with the mains adapter in place; FIG. 4*b* shows a similar side view. As adapter body 200 is engaged with device body 100, mating flange 210 on adapter body 200 engages mating ridge 110 on device base 102. This provides a secure mechanical connection between base 102 and adapter body 200. As adapter body 200 is further engaged to device body 100, receptacle body 202 of adapter body 200 slides into cavity 112. Receptacle contacts 204 slide over prongs 104. Electrical connections (not shown) connect receptacle contacts 204 to mains connectors 206. Receptacle body 202 substantially occupies cavity 112, so that when adapter body 200 is in place on device 100, prongs 104 are substantially enclosed within receptacle connectors 204 and receptacle body 202, providing physical and electrical isolation and shock protection. Thus, with an adapter in place such as that shown in FIG. 4*a*, electrical power from the mains outlet flows through mains connectors 206 which are connected to receptacle contacts 204 which mate with prongs 104, providing electrical power to the device.

It should be noted that there are many variations on the mechanical connection between device body 100 and adapter body 200. The embodiment chosen, using mating ridge 110 on base 102 secured to mating flange 210 on adapter body 200 provides visual cues to the user that adapter 200 slides on to base 102. An equally secure mechanical connection could be obtained by providing a ridge on receptacle body 202 mating with a matching groove in cavity 112.

While the invention has been described with reference to specific embodiments, it will be understood by those skilled in the art that various changes may be made and equivalents may be substituted for elements thereof without departing from the true spirit and scope of the invention. In addition, many modifications may be made without departing from the essential techniques of this invention as defined by the following claims.

What is claimed is:

1. A power connecting device for connecting an electronic appliance to an A.C. mains source comprising:

a device body having a base and a recess in the base extending to one end of the device body;

two metal prongs rotatably mounted in the device body adapted for electrically contacting said A.C. mains source, the prongs having at least two positions, the first position having the prongs extending outward from the device base, and the second position having the prongs folded into the device base and within the recess in the device base; and an adapter body having a receptacle body with two receptacle contacts for contacting the prongs in the device body, and mains connectors connected to the receptacle contacts, the adapter body connecting slidably to the device base such that the receptacle body fits within the recess in the device base and the prongs contact the receptacle contacts in the receptacle body.

2. The device of claim 1 further comprising:

securing means on the adapter body slidably mating with securing means on the device base for strengthening the mechanical connection between the adapter body and the device base.

* * * * *